US005722563A

United States Patent [19]

Hunts

[11] Patent Number: 5,722,563

[45] Date of Patent: Mar. 3, 1998

[54] TOOL FOR REMOVING PILLS AND THE LIKE FROM BLISTER PACKAGES

[76] Inventor: Larry D. Hunts, 1111 Netherlands Rd., Trail, Oreg. 97541

[21] Appl. No.: 892,475

[22] Filed: Jul. 14, 1997

Related U.S. Application Data

[63] Continuation of Ser. No. 706,378, Aug. 30, 1996, abandoned, which is a continuation of Ser. No. 402,292, Mar. 10, 1995, abandoned.

[51] Int. Cl.[6] ..... B65B 69/00

[52] U.S. Cl. ..... 221/25; 414/412

[58] Field of Search ..... 221/25, 26, 74; 30/363, 364; 414/411, 412; 294/118, 16

[56] References Cited

U.S. PATENT DOCUMENTS

| | | | |
|---|---|---|---|
| 604,564 | 5/1898 | Kraeuter | 30/363 |
| 612,665 | 10/1898 | How | 30/364 |
| 2,120,682 | 6/1938 | Sharp | 30/363 |
| 3,392,447 | 7/1968 | Hendricks et al. | 30/363 |
| 4,768,693 | 9/1988 | Tomaszewski | 30/363 |
| 4,909,414 | 3/1990 | Heath | 221/25 |
| 5,009,561 | 4/1991 | Lombardino | 221/25 |
| 5,038,968 | 8/1991 | Albetski | 221/1 |
| 5,472,115 | 12/1995 | Whiton | 221/25 |

FOREIGN PATENT DOCUMENTS

| | | | |
|---|---|---|---|
| 0305895 | 3/1989 | European Pat. Off. | 221/25 |
| 1608034 | 11/1990 | U.S.S.R. | 294/118 |
| 4818 | 2/1910 | United Kingdom | 30/363 |

*Primary Examiner*—H. Grant Skaggs
*Attorney, Agent, or Firm*—Olson & Olson

[57] ABSTRACT

A hand tool for quickly and effortlessly removing common forms of tablets and capsules individually from blister card and strip packaging is provided in a simplified form generally similar in overall appearance to a pliers-type hand tool. After positioning a desired pill-containing pocket of a blister package on the specially-configured lower jaw of the tool, the handles are squeezed together, pivoting the opposing jaw member downward against the top of the pill pocket and forcing the pill contained therein to move downwardly through an opening in the lower jaw, tearing the foil cover sheet of the package, whereupon the tablet will fall freely into a tablet-catching bucket member disposed beneath the lower jaw where the pill is maintained safely against inadvertent dropping or misplacing.

8 Claims, 3 Drawing Sheets

TOOL FOR REMOVING PILLS AND THE LIKE FROM BLISTER PACKAGES

This application is a continuation of application Ser. No. 08/706,378 filed 30 Aug. 1996, now abandoned which is a continuation of Ser. No. 402,292 filed Mar. 10, 1995, now abandoned.

BACKGROUND OF THE INVENTION

This invention relates to devices arranged to facilitate the removal of pills and the like from blister type packaging cards and strips commonly being used as an alternative to bottle-type bulk packaging of pharmaceuticals and such. More particularly, this invention provides a simplified hand tool arranged primarily for the easy and convenient dispensing of individual doses of pre-packaged, individually wrapped tablets, capsules, etc. by a user, as distinguished from the prior art devices which heretofore have been provided only for larger-scale dispensing situations routinely encountered by the staff and caregivers in the medical profession.

U.S. Pat. Nos. 4,909,414 (Heath—Mar. 20 1990) and 5,038,968 (Albetski—Aug. 13, 1991) illustrate the most relevant prior art known to applicant concerning the present invention. In this regard, both references provide table or counter-supported tray-like base units having a plurality of elongated channels or troughs arranged to receive an overlying blister card containing a multiplicity of individually-packaged pharmaceutical tablets. A roller member, either separate and hand-propelled ('968) or integral and mechanically-driven ('414) is rolled over a blister card disposed on the channeled base units whereupon rows of individually packaged pills are forced through the protective cover sheet enclosing the pill-containing pockets and into the associated channels for bulk dispensing. While these are practical and efficient devices in situations where large numbers of identical pills carried in identical packaging carts are needed at one time, such as in hospitals and the other various high-volume circumstances described in the patents, the devices are structurally and functionally and unsuitable and inconvenient for the very low-volume and periodic usage typical in households and institutions where only one or a few individual doses of medication need to be removed from various blister cards at any given time.

SUMMARY OF THE INVENTION

In its basic concept this invention provides an extremely efficient yet simplified hand tool arranged to remove individual tablets and the like from foil or blister type packaging cards or strips.

It is by virtue of the foregoing basic concept that the principal objective of this invention is achieved; namely, to provide a simple, hand-operated, plier-type tool to enable even individuals with extremely limited digital strength or dexterity to easily and successfully access and self-dispense medications so packaged.

Another object of this invention is the provision of a pill removing hand tool of the class described which facilitates the cutting of the foil cover sheet of the blister package as the table-T is being pressed thereagainst in order to assure against breaking or powdering of the table which could result in a loss of proper dosage.

Another object of this invention is the provision of a pill removing hand tool of the class described which is fully operably in conjunction with any conventional size, shape and type of pill including round and oval tablets, caplets, capsules and others typically provided in blister-type packaging strips and cards.

A still further object of this invention is the provision of a pill removing hand tool of the class described which may also be provided in the form of a free-standing surface-supported device operable by a user's arm, for use by persons having severe or complete loss of hand function.

A still further object of this invention is the provision of a pill removing hand tool of the class described which is of simplified construction for economical manufacture and ease of use.

The foregoing and other objects and advantages of this invention will appear from the following detailed description, taken in conjunction with the accompanying drawings of preferred embodiments of the invention.

Figure 1:
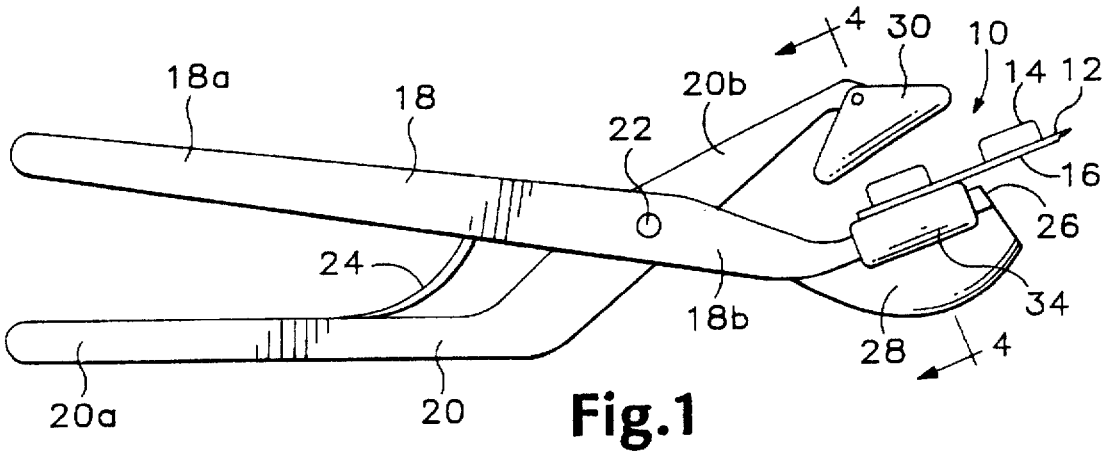
FIG. 1 is a side elevation of a hand tool embodying the features of this invention, a blister package having been positioned preliminary to operation of the tool.
Figure 2:
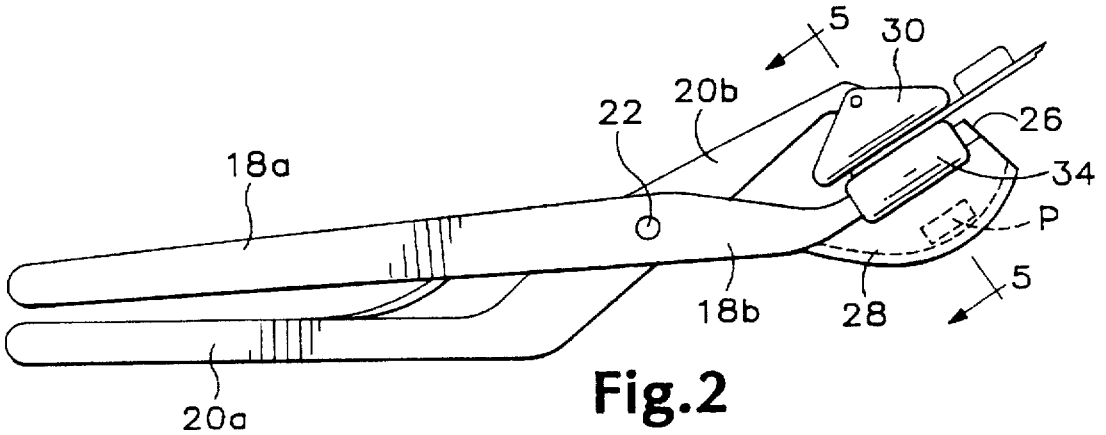
FIG. 2 is a side elevation of the hand tool of FIG. 1 shown in clamped position after being operated, the pill having been removed from its packaging and shown in broken lines as being contained within the pill-catching bucket.
Figure 3:
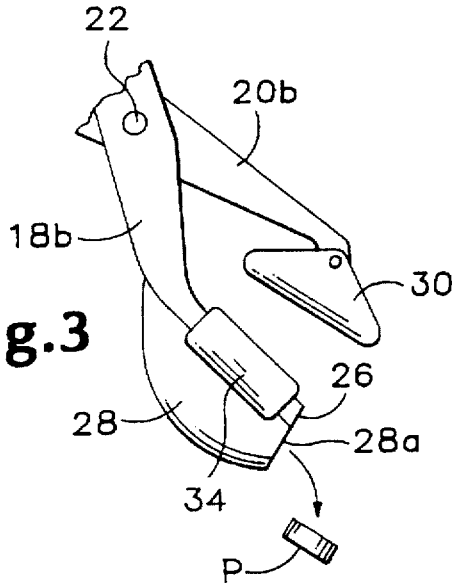
FIG. 3 is a fragmentary side elevation of the hand tool of FIGS. 1 and 2 illustrating how a pill may be dispensed into a user's hand after the tool has been operated to remove the pill from its blister package.

FIG. *6a–6c* are plan views illustrating examples of the various cutter openings that may be provided through the pill hole module shown in FIGS. 1–3 to accommodate different types of tablets.

Figure 6A:
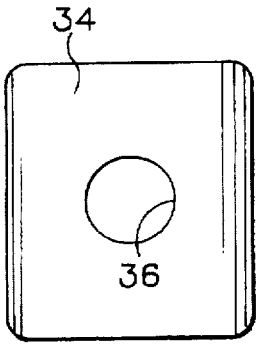
Figure 6B:
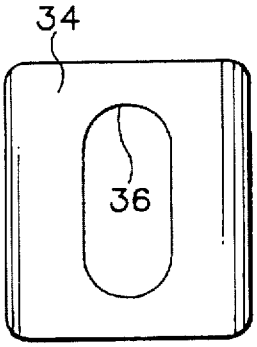
Figure 6C:
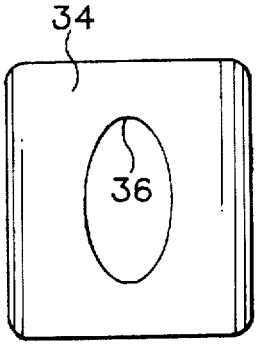
Figure 7:
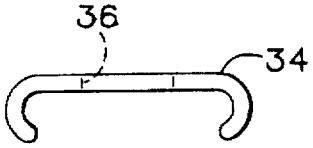

FIG. 7 is an end view of a removable pill hole module as seen viewed from the bottom in FIG. 6.

Figure 8:
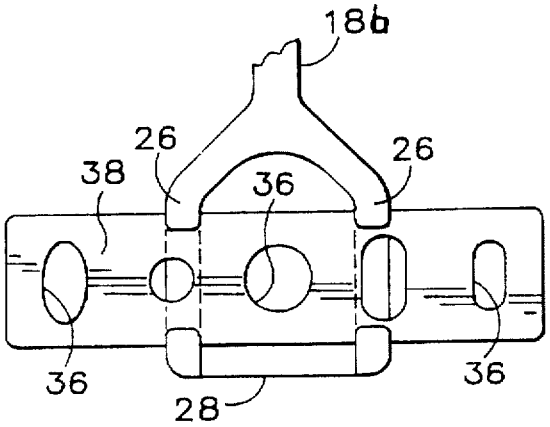

FIG. 8 is a fragmentary plan view of a second embodiment of the working end portion of the lower arm member configured to mount a pill hole module slide member arranged to accommodate a plurality different of different types of tablets to be removed from blister packaging.

FIG. *8a* is a fragmentary plan view of a third embodiment of the working end portion of the lower arm member configured to mount a rotary pill hole module disk as an alternative to the slide member configuration of FIG. 8, parts otherwise hidden being shown in broken lines.

Figure 9:
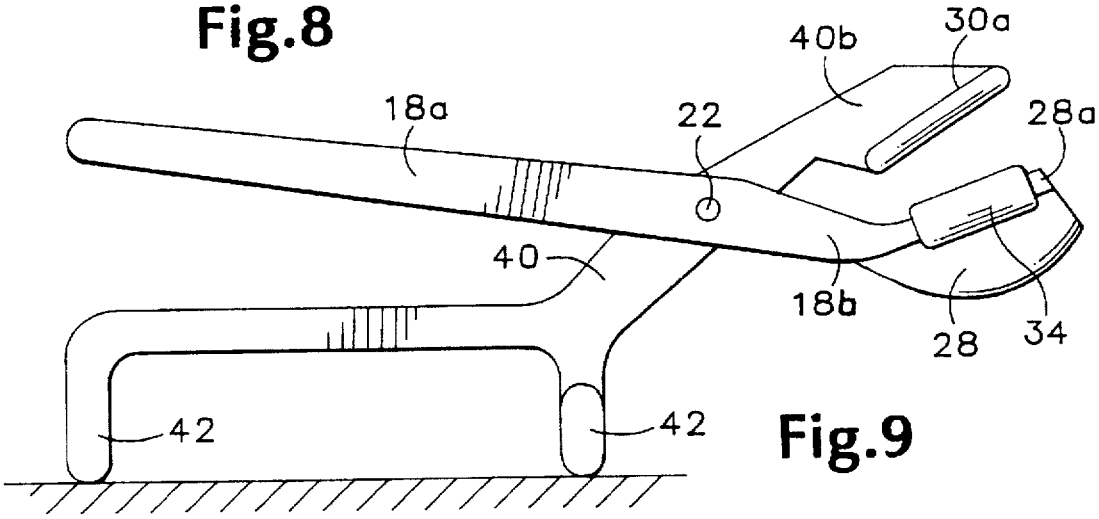

FIG. 9 is a fragmentary side elevation of another embodiment of the hand tool of this invention illustrating the device as a free standing unit for placement and operation on an underlying table or counter surface.

DESCRIPTION OF THE PREFERRED EMBODIMENTS

It is increasingly more common in the pharmaceutical industry to package pills and the like in blister-type packaging that contain a plurality of individually sealed tablets on strips or cards that permit individual doses to be administered without exposing the remaining product to the enviroment until they in turn are actually used. This ensures the freshness of the product; extends the shelf life of the product; guarantees against tampering and serves to help "child-proof" the product.

Unfortunately, for all its attributes, this is also one of the most user-unfriendly, frustrating and infuriating forms of packaging that has yet been devised. In this regard, a pharmaceutical blister package 10 is typically provided as a card or strip comprising a clear plastic sheet 12 formed with a plurality of rows of regularly spaced apart pockets 14 into which a single pill P is placed. An overlying foil or plastic cover sheet 16 is then bonded to the first sheet 10, thus closing the pockets and sealing the pills therein. Perforated tear lines are typically provided between adjacent pockets so that used sections of the card may be separated and discarded as they are used and so that unused sections may be more conveniently carried with the user until needed.

Without exception, the single most common complaint that inherently accompanies this form of packaging is the nightmare that is often involved in removing the tablets when they are needed. Often considerable pressure is required against the clear sheet side of the pocket simply to collapse the pocket material inwardly against the tablet and invariably an inordinate amount of force is then additionally required before the foil cover sheet will stop simply deforming and actually tear so that the pill may be pushed therethrough. Sometimes this happens suddenly, and the pill is unexpectedly pressed through the foil and often inadvertently dropped, and other times the foil does not tear at all and the pill is literally crushed in the effort to free it from its packaging. In all cases however the removal operation requires two hands, a fair amount of manual dexterity in both hands, and a good amount of strength in the fingers of at least one hand.

Sadly, but not unexpectedly, the largest single group of people using such medications are those who, as a group, are the ones most adversely affected by this particular type of packaging: The elderly and the infirm who for one reason or another have lost the digital strength and dexterity required to remove pills from their blister packaging. This situation can readily be appreciated by persons who have severe arthritis in the hands and aside from the functional limitations that may be imposed, serious discomfort is an additional consequence of the effort when dealing with these packages. Indeed, even rather simple and temporary incumbrances such as casted arms and even sprained fingers can make access to simple medications very difficult. For those without physical limitations of the hands, this packaging is often regarded as an annoying nuisance, especially when the cover sheet material is unduly resistant to tearing.

The present invention provides an extremely simply, convenient and easily operable solution to the above problems, the basic concept of the invention being readily identifiable is simply in viewing the operation of the device as shown in FIGS. 1, 2 and 3 of the drawings. As illustrated, the invention provides a structurally simple hand tool generally similar in overall appearance to a pair of pliers wherein the tool comprises a pair of opposite arm members 18, 20 connected pivotally together by a pivot pin 22, which effectively divides each arm member into a handle end portion 18*a*, 20*a* and a working end or jaw portion 18*b*, 20*b*. As illustrated, a spring member 24 may for convenience be provided to urge the arm members 18, 20 to return to the normally at rest position shown in FIG. 1 in which the jaws of the tool are maintained in open condition for ubobstructed placement or removal of a pill card.

In its basic form, the tool of this invention is arranged with one working end portion 18*b* configured to terminate in a pair of projecting supports 26 spaced apart from each other a distance sufficient to provide an opening through which a pill may pass freely. These supports 26 provide an underlying base for supporting a blister package during operation of the tool as will be explained. In the preferred embodiment, the projecting supports 26 mount an underlying pill-catching pocket member or bucket 28, which may as illustrated be open at its front end 28*a*, the bucket configured to underlie the opening between the supports 26 to receive and hold a pill passing therethrough, as will become apparent.

Figure 4:
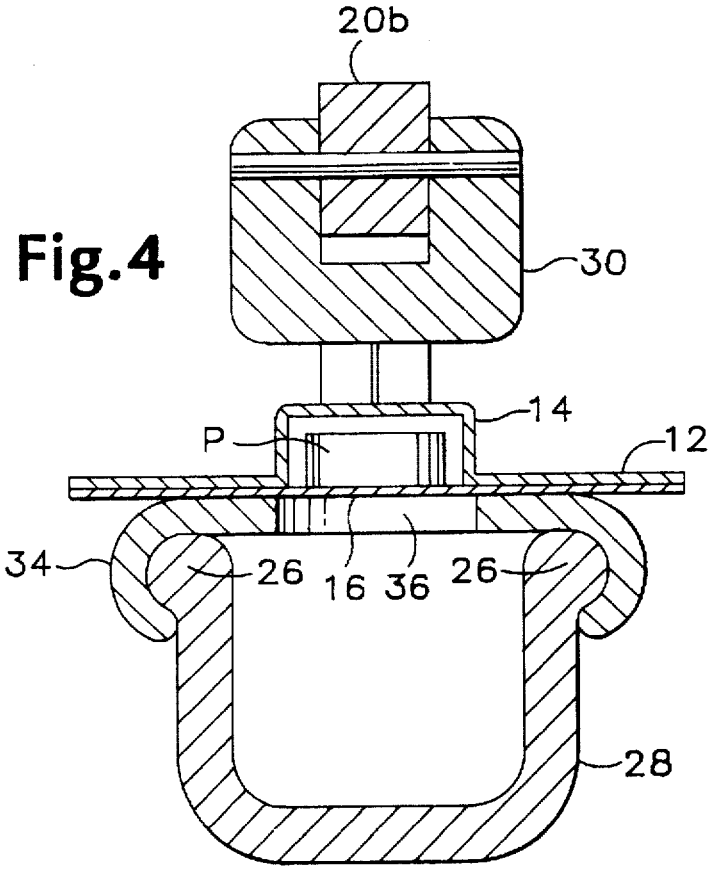
FIG. 4 is a sectional view of the hand tool of FIG. 1 taken along the line 4—4 in FIG. 1.
Figure 5:
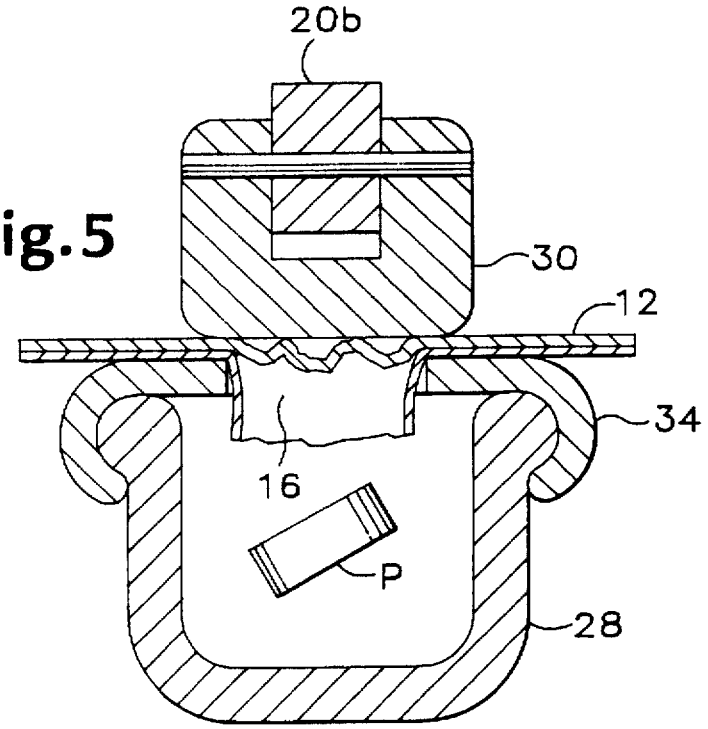
FIG. 5 is a sectional view of the hand tool illustrated in FIG. 2 as taken along the line 5—5 in FIG. 2.

The jaw or working end 20*b* of the opposing arm member 20 terminates in a pressing member 30, as seen in FIGS. 1 and 4. This pressing member is configured to provide a confronting surface arranged to provide means for engaging and pressing against the outer surface pocket of a blister card positioned cover sheet-side down on the supports 26. In the embodiment illustrated, the pressing member 30 is shown as a separate element mounted pivotally by pivot pin 32 to the end portion 20*b*. This arrangement permits the pressing element to adjust its orientation in order to maintain the greatest amount of surface contact against the pocket of the package as it is pressing thereagainst. However, it will be understood from FIG. 9 that although this may be a preferred arrangement, it is not necessary to the successful operation of the tool. Alternatively, a pressing element 30*a* (FIG. 9) may instead be formed as an integral feature of the terminal end of the working portion 20*b* of the arm member 20.

The invention may include cutter means to facilitate the initial tearing of the foil layer as the pill is pressed downwardly thereagainst during operation of the hand tool. In the preferred embodiment illustrated, a pill hole module 34 is removably mounted on the supports 26 and spans the opening therebetween, the module forming an underlaying base platform beneath the foil layer of the pill-containing pocket of the package. An opening 36 is provided through the module, the opening configured to be larger in size and preferably generally similar in shape to the type of pill being removed from its packaging. In this manner, when the pill is forced downwardly into the opening 36, the foil is forced to tear instead of simply deforming. As illustrated in FIG. 6, different module openings may be provided to accommodate virtually any type or shape of pill or capsule as may be encountered.

Figure 8A:
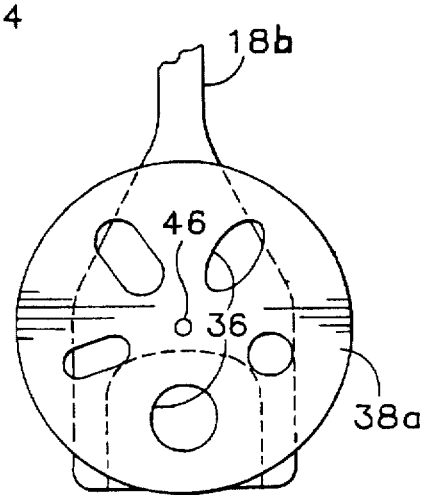

FIG. 8 illustrates the hand tool of this invention wherein the cutter means previously described in connection with the pill hole module is provided in the alternative form of a slide member 38 arranged to accommodate virtually any tablet configuration. In this case, the slide is operably mounted on the base supports 26 for positioning of a desired cutter hole configuration over the opening between the support members 26. FIG. 8*a* simply illustrates the jaw member 18*b* configured instead to mount a rotary pill hole disk 38*a* by pivot pin 46, as an equally satisfactory alternative to the slide member 38 configuration of FIG. 8. It is to be understood of course that while the various embodiments of cutter means discussed hereinbefore are illustrative of satisfactory arrangements, other entirely suitable configurations are also contemplated and may alternatively be provided for the purpose.

The operation of a hand tool of this invention, although readily apparent from FIGS. 1, 2 and 3 of the drawings is as follows: The hand tool is grasped in one hand and a blister package is positioned on the supports 26 so that the pocket of the blister pack is positioned over the opening between the supports as seen in FIGS. 1 and 4. The hand grips are squeezed toward each other, pivoting one jaw member toward the other and moving the pressing member downwardly into contact with the top surface of the pocket, whereupon continued downward movement of the pressing member collapses the blister package pocket inwardly forcing the pill downwardly, tearing the cover sheet of the blister package, allowing the pill to drop freely downwardly through the opening. In the embodiment illustrated, the freed pill falls into the bucket and, since the bucket is provided with an open front end 28*a*, the pill may then be dispensed into the user's hand simply by tilting the hand tool downwardly as in FIG. 3. It is to be understood that the amount of force required to squeeze the handle members can be varied in any number of conventional ways including varying the pivot point of the arm members and hence the resulting leverage function; varying the type and tension of the spring means illustrated generally at 24; providing gearing and other mechanical advantage structure between the handle portion and working portions of the arms; and other known methods.

As has been previously discussed, some people may for a variety of reasons not possess sufficient hand function to adequately grasp, hold and squeeze even the previously described hand tool successfully. The present invention contemplates this instance in the embodiment of FIG. 9 wherein the arm member 20 of the previous embodiment is replaced by an alternative arm member 40 configured to mount a supporting base structure. In this regard, leg structure 42 is shown in the drawings arranged to support the device in stable condition on an underlying surface 44 such as a table or counter top. The supporting base structure may be integrally formed with the arm member 40 as shown, or alternatively the base structure may if desired be provided separately, and configured for removable attachment to the handle portion 20*a* of the hand tool embodiment described earlier. The operation of this embodiment is essentially identical to the foregoing embodiment of the hand tool except that the user may simply press downwardly on the arm 18*a* of the free standing device in whatever manner is possible or convenient.

It will be apparent to those skilled in the art that various changes other than those already described may be made in the size, shape, type, number and arrangement of parts described hereinbefore without departing from the spirit of this invention and the scope of the appended claims.

Having thus described my invention and the manner in which it may be used I claim:

1. A hand tool for removing tablets and the like contained in blister packaging having a top sheet forming a pocket containing a tablet of predetermined size and peripheral shape and a cover sheet affixed to the top sheet and covering and sealing the tablet-containing pocket, the hand tool comprising:

a) first and second arm members pivotally connected together and forming a pair of opposite handle end portions extending in one direction from the pivot connection and a pair of opposing working end jaw portions extending in the opposite direction from the pivot member, the working end jaw portions movable toward and away from each other about the pivot connection by movement of the associated handle end portions, b) module member support means on the working end jaw portion of the first arm member for mounting a module member thereto secured against vertical movement therefrom, c) a module member mounted on said support means and configured to provide an underlying supporting base for supporting the cover sheet of a blister package against deformation, said module member having at least one specifically-configured, tablet-receiving opening arranged for registry with a tablet in a blister package, said specifically-configured, tablet-receiving opening having a particular, peripheral shape substantially matching and dimensioned slightly larger than the said predetermined shape and size of a particular tablet in a blister package on the module member arranged in registry with the opening therethrough, d) a pressing member on the working end jaw portion of the second arm member arranged to align with said opening in the support means, e) the pressing member being arranged to engage the outer surface of a tablet-containing pocket of a blister package supported on the support means and, upon movement of the pressing member toward said support means, to press the pocket inwardly, forcing the tablet to press against the cover sheet which, by virtue of its support against deformation by the underlying module member and the matching shape and close dimensions of the aligned tablet and said opening, tears open under initial pressing force to allow the tablet to pass through said opening.

2. The hand tool of claim 1 wherein the module member support means includes a pair of laterally spaced forwardly projecting supports configured for releasably mounting a module member removably on and spanning said spaced supports with said specifically-configured opening retained in a desired, fixed position of orientation between said space supports.

3. The hand tool of claim 2 including a plurality of module members configured for exchangeable mounting on said projecting supports and each having a different opening shape slightly larger than and substantially matching the corresponding shape of different types of tablet to be removed from a blister package.

4. The hand tool of claim 2 including laterally spaced leg members on the front and rear ends of the handle end portion of the second arm member for supporting the hand tool for operation in free-standing, stable condition on an underlying support, the spacing between the legs on the front and rear ends affording engagement by a hand which also engages the handle end portion of the first arm member.

5. The hand tool of claim 1 wherein the support means includes a pair of laterally spaced forwardly projecting supports having a pair of module guides on each of said supports, and said module member is mounted on said supports between said guides for lateral movement across said supports, the module member having a plurality of said tablet-receiving openings therethrough, each said opening being of different shape and size for matching a tablet of corresponding peripheral shape and slightly smaller dimensions.

6. The hand tool of claim 1 including a tablet-catching pocket secured to said module support means and extending downwardly therefrom for receiving tablets removed from a blister package.

7. The hand tool of claim 1 including spaced leg members on the front and rear ends of the handle end portion of the second arm member for supporting the hand tool for operation in free-standing, stable condition on an underlying support, the spacing between the legs on the front and rear ends affording engagement by a hand which also engages the handle end portion of the first arm member.

8. The hand tool of claim 1 wherein said module member is provided with a plurality of different tablet openings corresponding in shape and slightly larger size with different shapes and sizes of tablets, and the module member is mounted on the module member support means for adjustment of the module member thereon to selectively position any desired one of said plurality of openings operatively in registry with the overlying tablet-containing pocket of a blister package.

* * * * *